United States Patent [19]

Poling

[11] Patent Number: 4,920,240

[45] Date of Patent: Apr. 24, 1990

[54] METHOD OF OPERATING AN ELECTRIC CIRCUIT CONTROLLING DEVICE

[75] Inventor: Ronald W. Poling, Morrison, Ill.

[73] Assignee: General Electric Company, Fort Wayne, Ind.

[21] Appl. No.: 221,113

[22] Filed: Jul. 19, 1988

Related U.S. Application Data

[62] Division of Ser. No. 107,448, Oct. 13, 1987, abandoned, which is a division of Ser. No. 932,126, Nov. 18, 1986, Pat. No. 4,703,140.

[51] Int. Cl.[5] ..... H01H 35/34

[52] U.S. Cl. ..... 200/83 P; 200/81.4; 200/406

[58] Field of Search ..... 200/67 R, 67 C, 67 D, 200/67 DB, 67 PK, 153 L, 153 LB, 81 R, 81.4, 81.5, 83 P, 83 R, 83 J, 83 S, 302.1, 406; 340/626; 92/5 R; 307/118; 337/318, 320; 73/717, 723, 861.47

[56] References Cited

U.S. PATENT DOCUMENTS

| | | | |
|---|---|---|---|
| 3,330,925 | 7/1967 | Andrew | 200/83 P |
| 4,091,249 | 5/1978 | Huffman | 200/83 P |
| 4,150,264 | 4/1979 | Lieberman | 200/153 LB |
| 4,194,103 | 3/1980 | Smith | 200/83 P |
| 4,328,406 | 5/1982 | Evans | 200/83 P |
| 4,330,069 | 5/1982 | Poling | 200/83 P |
| 4,330,695 | 5/1982 | Poling | 200/83 P |
| 4,401,964 | 8/1983 | Payne | 200/83 P |
| 4,464,551 | 8/1984 | Johnson | 200/83 P |
| 4,532,389 | 7/1985 | Wards | 200/83 P |
| 4,563,550 | 1/1986 | Bertina | 200/5 A |
| 4,703,140 | 10/1987 | Poling | 200/83 P |

*Primary Examiner*—Gerald P. Tolin

*Attorney, Agent, or Firm*—Ralph E. Krisher, Jr.

[57] ABSTRACT

A method of operating an electric circuit controlling device with the device having a housing, a seat in the housing, and a snap action member having discrete snap action movement between a stable configuration and an unstable configuration. The snap action member in its stable configuration is moved from a preselected position displaced from the housing seat into engagement therewith, and the discrete snap action movement of the snap action member from the stable configuration toward the unstable configuration thereof is effected when the snap action means is engaged with the housing seat.

26 Claims, 5 Drawing Sheets

METHOD OF OPERATING AN ELECTRIC CIRCUIT CONTROLLING DEVICE

CROSS-REFERENCE TO RELATED APPLICATIONS

This application is a division of the commonly assigned copending parent application Ser. No. 107,448 filed Oct. 13, 1987 and now abandoned which was a division of grandparent application Ser. No. 932,126 filed Nov. 18, 1986 (now U.S. Pat. No. 4,703,140 issued Oct. 27, 1987), and such parent and grandparent applications are each incorporated by reference herein.

FIELD OF THE INVENTION

This invention relates in general to an anti-skid brake system for an automotive vehicle and in particular to a method of operating an electric circuit controlling device utilized in such system.

BACKGROUND OF THE INVENTION

In the past, various different anti-skid brake systems have been utilized on automotive vehicles and various different types of electric circuit controlling devices have been utilized in such systems to control or regulate the operation thereof.

In at least some of the past anti-skid brake systems of the hydraulic type, a pump was energized to establish fluid pressure in such systems which was utilized to effect the actuation of the vehicle brakes when braking action was initiated by a vehicle operator, and electronic circuitry was utilized to effect the anti-skid features or operation of the vehicle brakes during such braking action. The electronic circuitry of the anti-skid brake system was enabled through an electric circuit controlled by an electric circuit controlling device in response to fluid pressure of a preselected value generated in such system by the pump thereof and subjected to the electric circuit controlling device. A relay for the pump was picked-up and dropped-out in another electric circuit controlled by the electric circuit controlling device thereby to control the energization and deenergization of the pump when the system fluid pressure obtained other values greater than that at which the electronic circuitry was enabled.

To effect the aforementioned enablement of the electronic circuitry and the control of the pump relay, the past electric circuit controlling devices employed toggle switches for switching in the electric circuits associated with the electronic circuitry and the pump relay. One of the disadvantages or undesirable features of the aforementioned past electric circuit controlling device is believed to be that the toggle switches utilized therein did not have a clean snap or snap-action. For instance, it is believed that the switch arm of these toggle switches tended to roll its contact into engagement with a stationary contact therefor thereby to lose contact continuity which resulted in switch chatter. Another of the disadvantageous or undesirable features of the aforementioned past electric circuit controlling devices is believed to be that contact bounce time of these toggle switches was too great. For instance, when the switch arm of the toggle switches engaged its contact with the stationary contact therefor, the switch arm contact tended to bounce into circuit making engagement with the stationary contact. In response to this bouncing action of the switch arm contact, it is believed that the pump relay may have been repeatedly and quickly energized and deenergized which may not only have adversely affected the operation of the pump but may have also resulted in the welding of the relay contacts.

SUMMARY OF THE INVENTION

Among the several objects of the present invention may be noted the provision of an improved method of operating an electric circuit controlling device which overcomes the above discussed disadvantageous or undesirable features, as well as others, of the prior art; the provision of such improved method which utilize snap-action means operable with discrete snap action movement between a stable configuration and an unstable configuration for operating a switching means associated therewith between a plurality of circuit controlling positions; the provision of such improved method in which the snap action means is urged toward a preselected position displaced from a seat therefor prior to the discrete snap action movement of the snap action means; the provision of such improved method in which the resiliency of at least the at least one switching means is utilized to urge the snap action means toward its preselected displaced position; the provision of such improved method having a force transmitting means operable generally in response to a force exerted thereon for actuating the snap action means with the operation of the force transmitting means being opposed by a caged resilient means which obviates such operation until the force attains a preselected force level; the provision of such improved method in which means are utilized for changing the direction of the force exerted in one direction by the snap action means upon the discrete snap action movement thereof and for applying the force in the changed direction onto the switching means to effect their operation from one of the circuit controlling positions toward the other of the circuit controlling positions thereof; and the provision of such improved method in which the component parts utilized therein are simple in design, easily assembled, and economically manufactured. These as well as other objects and advantageous features of the present invention will be in part apparent and in part pointed out hereinafter.

In general and in one form of the invention, a method is provided for operating an electric circuit controlling device. The device includes snap action means for discrete snap action movement between a stable configuration and an unstable configuration, a housing, and a seat in the housing. In the practice of this method, the snap action means in its stable configuration is moved from a preselected position displaced from the housing seat into engagement therewith, and the discrete snap action movement of the snap action means from the stable configuration toward the unstable configuration thereof is effected when the snap action means is engaged with the housing seat.

Also in general, a method in one form of the invention is provided for operating an electric circuit controlling device. The electric circuit controlling device includes snap action means for discrete snap action movement between a stable configuration and an unstable configuration thereof, translating means operable generally for changing the direction of a force applied thereto, and at least one switching means operable generally for switching between a plurality of circuit controlling positions. In the practice of this method, the discrete snap action movement of the snap action means is effected from the stable configuration toward the unstable configuration thereof, and thereby the force is applied onto the force transmitting means. The translating means is operated in response to the force applied thereon so as to change the direction of the force, and the force in the changed direction thereof is transmitted from the translating means to the at least one switching means to effect the operation of the at least one switching means from one of the circuit controlling positions toward another of the circuit controlling positions thereof.

BRIEF DESCRIPTION OF THE DRAWINGS

Corresponding reference characters indicate corresponding parts throughout the several views of the drawings.

The exemplifications set out herein illustrate the preferred embodiment of the invention in one form thereof, and such exemplifications are not to be construed as limiting either the scope of the invention or the scope of the disclosure thereof in any manner.

DETAILED DESCRIPTION OF THE PREFERRED EMBODIMENT

Figure 1:
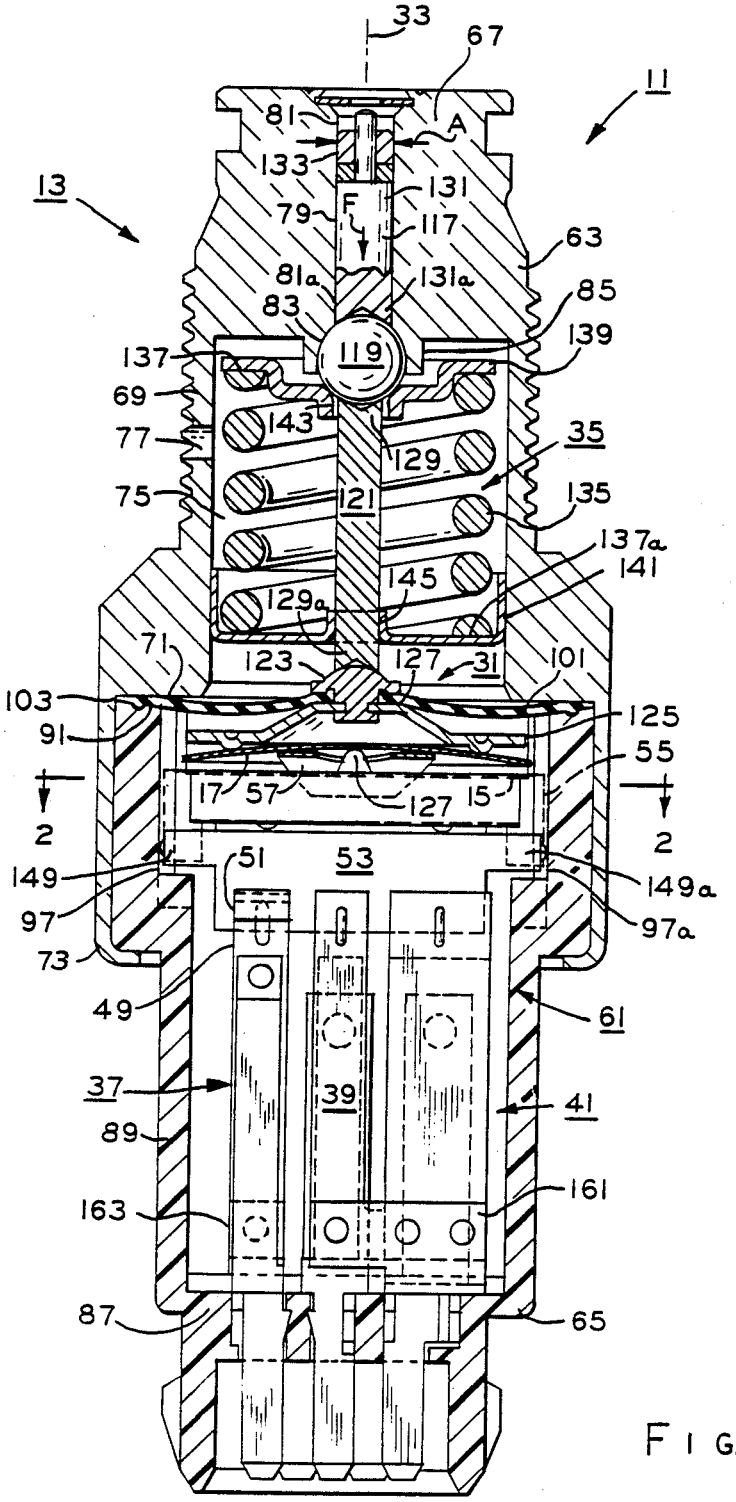
FIG. 1 is a sectional view showing an electric circuit controlling device in crosssection and illustrating principles which may be practiced in a method of operating an electric circuit controlling device in one form of the invention.
Figure 2:
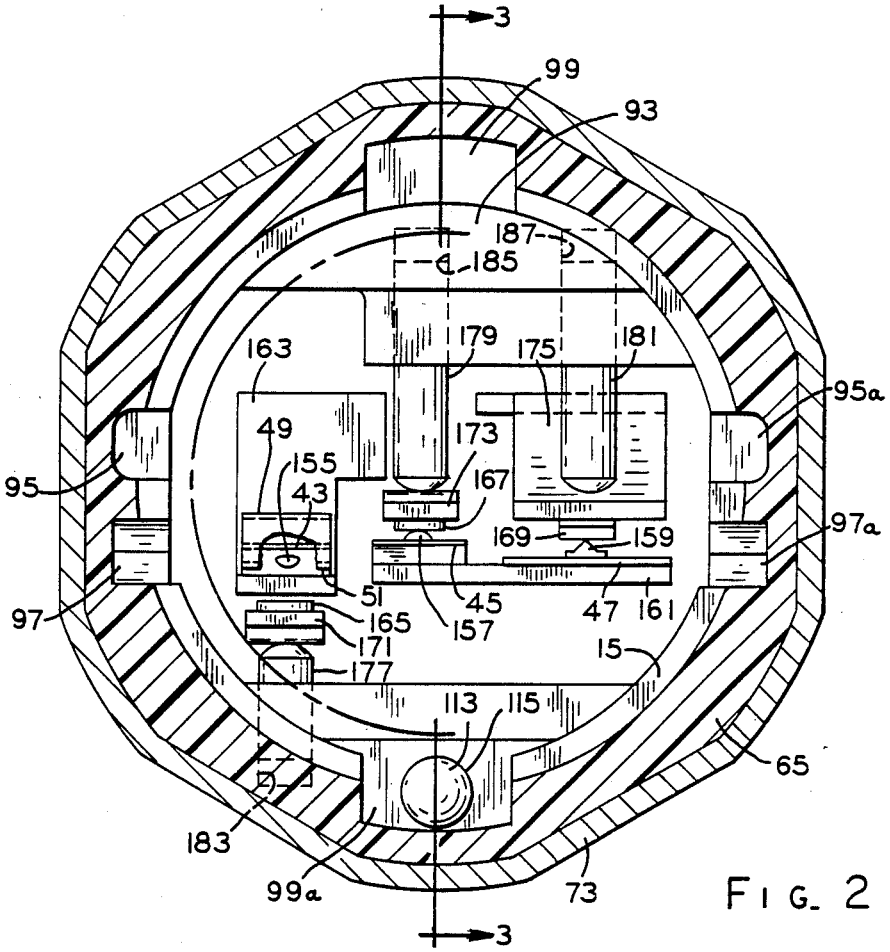
FIG. 2 is a sectional view taken along line 2—2 in FIG. 1 with some component parts of the electric circuit controlling device removed for clarity.
Figure 3:
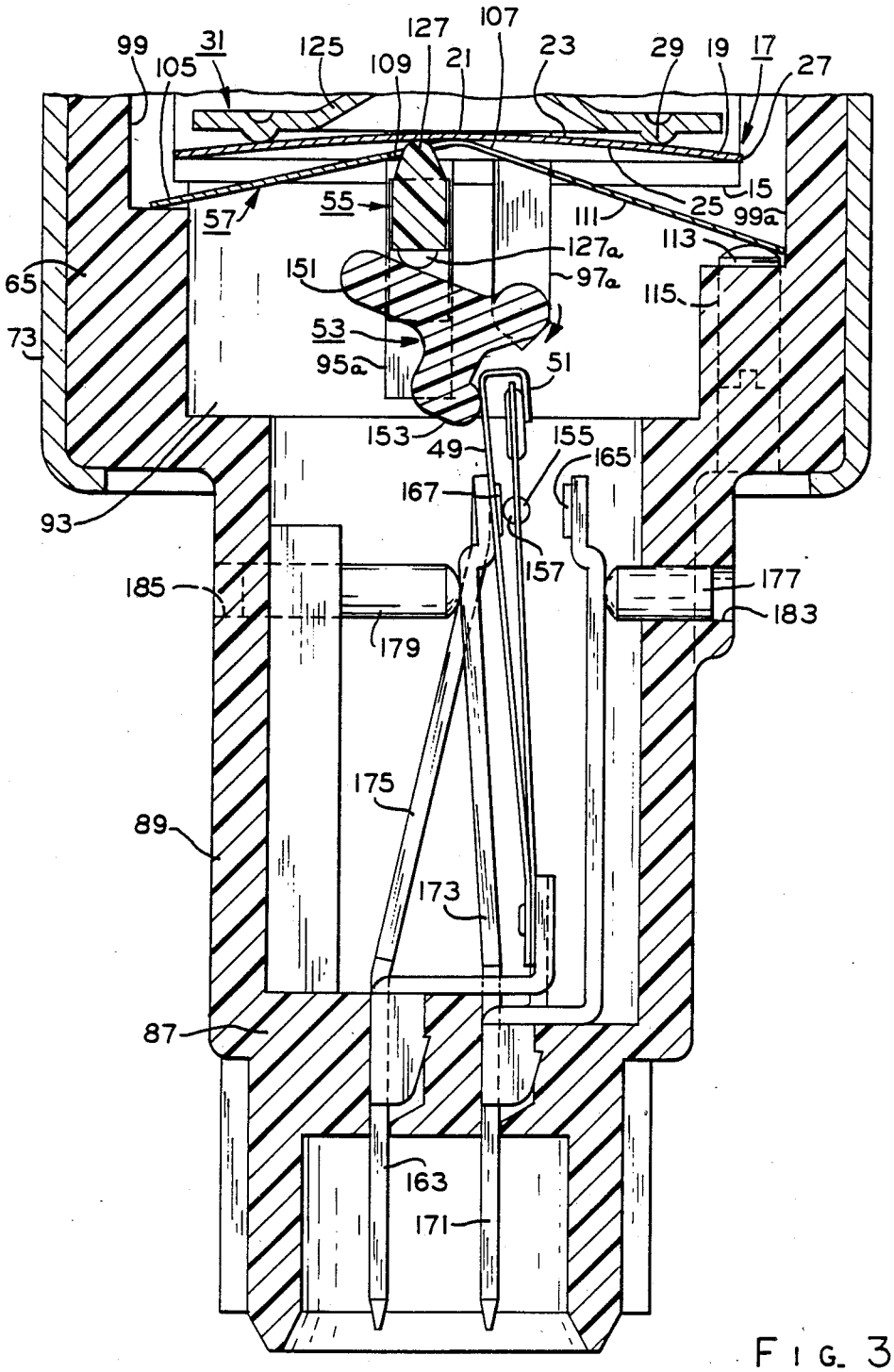
FIG. 3 is a sectional view taken along line 3—3 of FIG. 2.
Figure 4:
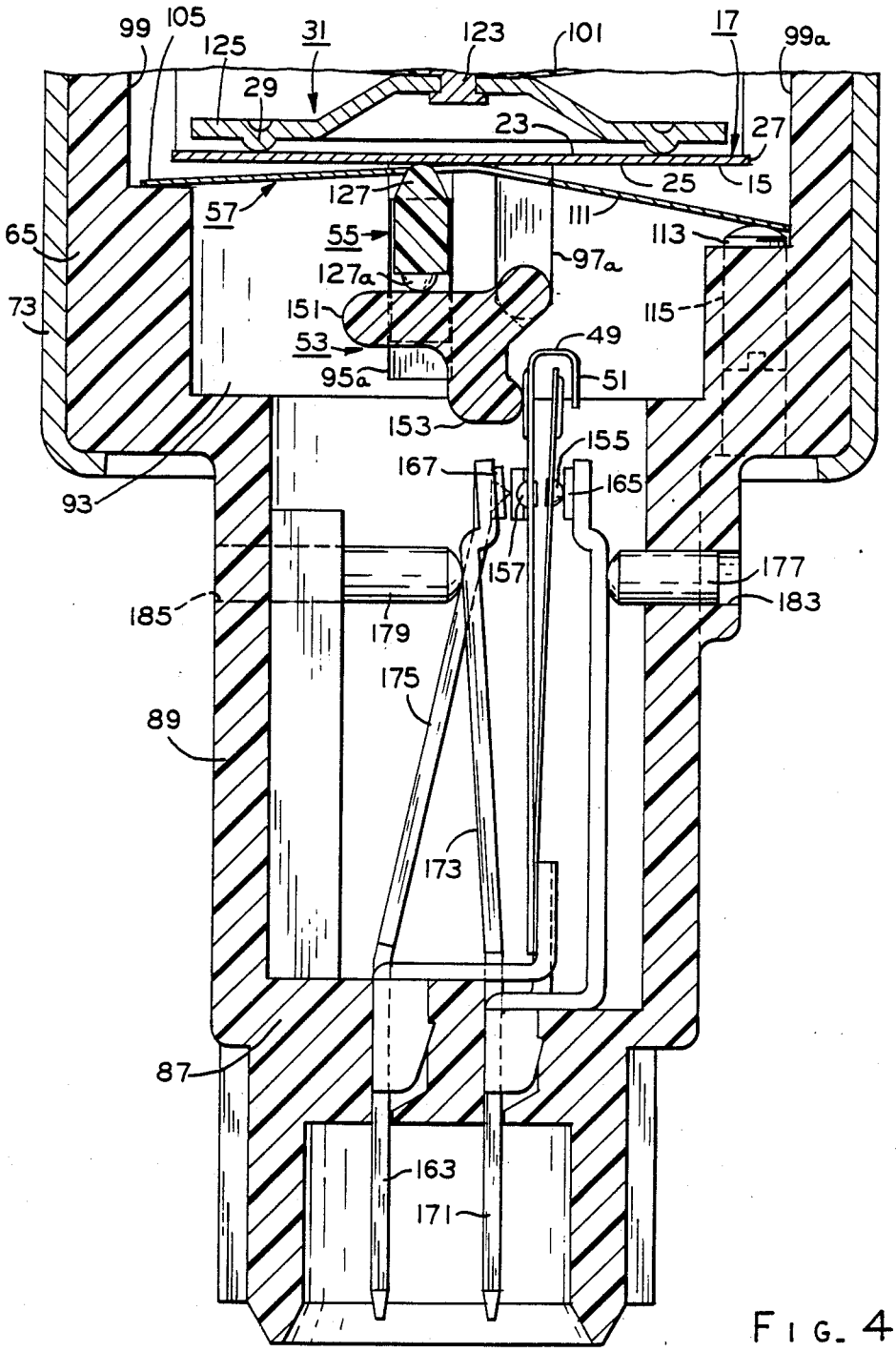
FIG. 4 is generally the same as FIG. 3 but showing the component parts thereof in their actuated positions.

Referring now to the drawings in general, there is illustrated in one form of the invention a method of operating an electric circuit controlling device 11, such as for instance a fluid pressure responsive staging switch or the like, which may be utilized in a typical anti-skid brake system for an automotive vehicle (not shown) (FIGS. 1—6). Device 11 includes a housing 13, a seat 15 therein and snap action means 17, such as for instance a monostable snap action member or snap disc or the like, for discrete snap action movement between a stable configuration and an unstable configuration thereof (FIGS. 1, 3 and 4). In the practice of this operating method, snap action means or snap disc 17 in its stable configuration is disposed in a preslected position displaced or otherwise predeterminately spaced from seat 15 therefor in housing 13 (FIGS. 1 and 3). A force F in excess of a preselected force level is exerted or applied onto snap disc 17, and in response thereto, the snap disc is moved from its preselected displaced position toward housing seat 15 (FIGS. 3 and 4). At least generally as force F attains another preselected force level predeterminately greater than the first named preselected force level, snap disc 17 is seated on housing seat 15, and the discrete snap action movement of the snap disc from the stable configuration toward the unstable configuration thereof is effected when force F attains a third preselected force level predeterminately greater than the aforementioned another preselected force level (FIGS. 3 and 4).

More particularly and with specific reference to FIGS. 1, 3 and 4, snap disc 17 may be formed in a manner well known in the art from any suitable generally thin metallic sheet material, such as for instance a stainless steel or the like, into the slightly bowed stable configuration thereof. In its stable configuration, snap disc 17 includes a generally circular body 19 having a generally arcuate, dome or dome-shaped section or portion 21, and a pair of generally arcuate or dome-shaped sides or surfaces, such as convex and concave surfaces 23, 25, are oppositely provided on the body defining the dome-shaped section thereof. Convex and concave surfaces 23, 25 on snap dics 17 interconnect with an outer peripheral portion or marginal edge 27 thereof which defines a generally constant circumference of body 19 about at least a major portion thereof. While snap disc 17 and its above discussed shape is illustrated herein for purposes of disclosure, it is contemplated that various other snap discs having various other shapes may be utilized within the scope of the invention so as to meet at least some of the objects thereof.

In the preselected displaced position of snap disc 17, convex surface 23 thereof is seated against a generally circular or annular abutment, such as a ridge 29 or the like for instance, on a force transmitting means or member, indicated generally at 31, and marginal edge 27 on the snap disc is predeterminately spaced generally axially away from housing seat 15. Force transmitting means 31 is generally coaxially arranged with a centerline axis 33 of housing 13 and is movable therealong generally against the caged compressive force of a caged resilient means, indicated generally at 35, which is exerted on the force transmitting means urging it toward an at-rest position in the housing, as best seen in FIG. 1.

A set of switching means 37, 39, 41, which includes a set of generally elongate and resilient switch members or elements 43, 45, 47 or the like for instance, are operable generally in housing 13 for switching between a plurality of circuit controlling positions or switching modes, respectively. It may be noted that switching means 37 also includes a generally elongate and resilient overtravel member or spring 49 having a bent over or reentrant type flange or flange means 51 integrally formed therewith, and the overtravel spring is disposed generally in overlaying relation with switch element 43 so that the flange may drivingly engage the switch element, as discussed in greater detail hereinafter. The resiliency or resilient force of switch element 45 and overtravel spring 49 are applied or exerted against a rotatable means or member, indicted generally at 53, and when the switch elements are in one of the circuit controlling positions thereof, as best seen in FIG. 3, the resilient forces of switch element 45 and overtravel spring 49 rotate the rotatable means clockwise in the direction of the directional arrow in FIG. 3 toward an at-rest position of the rotatable means in housing 13 and into abutment or engagement with an actuator or plunger 55 which is linearly or reciprocally movable generally axially in the housing, i.e., generally parallel to centerline axis 33 thereof. In response to the aforementioned engagement with rotatable means 53, actuator 55 is biased toward an at-rest position thereof into engagement with concave surface 25 of snap disc 17 at least generally adjacent domed section 21 thereof. Thus, it may be noted that at least switch element 45, overtravel spring 49, rotatable means 53 and actuator 55 comprise a means for urging snap disc 17 toward its preselected displaced position biasing convex surface 23 of the snap disc into abutment with circular ridge 29 on force transmitting means 31 and thereby predeterminately spacing marginal edge 27 of the snap disc from housing seat 15 therefor. It may also be noted that rotatable means 53 is disengaged from switch element 47 when snap disc 17 is in its preselected displaced position spaced from housing seat 15. It may be further noted that a least the resilient forces of switch element 45 and overtravel spring 49 are utilized to effect the force level at which the discrete snap action movement of snap disc 17 between the stable and unstable configurations thereof occur, as discussed in greater detail hereinafter. Furthermore and if desired, adjusting or calibration means, such as for instance an adjusting strap 57 or the like, may be biased against concave surface 25 of snap disc 17 in housing 13 creating another adjusting or calibration force additive to that of switch element 45 and overtravel spring 49 for defining the aforementioned force level at which the discrete snap action movement of the snap disc occurs, as also discussed in greater detail hereinafter. Thus, when so utilized to calibrate device 11, adjusting strap 57 is included in the aforementioned means for urging snap disc 17 toward its preselected displaced position.

Force transmitting means 31 has an effective area A which is subjected to a fluid pressure to establish the aforementioned force F, and force F acts on the force transmitting means in opposition to the caged compressive force of caged resilient means 35, the resilient forces of switch elements 45 and overtravel spring 49 and the ajusting force of adjusting strap 57. Force transmitting means 31 is generally axially moved or displaced from its at-rest position in housing 13 along centerline axis 33 thereof against the aforementioned additive forces of caged resilient means 35, switch element 45, overtravel spring 49 and adjusting strap 57 when force F acting on the force transmitting means exceeds a preselected force level indicated at point B in the graph of FIG. 6, and since snap disc 17 is seated in its preselected displaced position against circular ridge 29 on the force transmitting means, the snap disc is, of course, conjointly movable with the force transmitting means toward housing seat 15. In response to this initial conjoint movement of snap disc 17 and force transmitting means 31, actuator 55 is axially driven or actuated through a part of its linear movement, and since the actuator and rotatable means 53 are engaged, the rotatable means is also driven or actuated through a part of its rotatable movement to actuate switch element 45 and overtravel spring 49 so as to move switch elements 43, 45 away from the one circuit controlling position thereof, as best seen in FIG. 3, toward another of the circuit controlling positions thereof, as best seen in FIG. 4. During the aforementioned initial conjoint movement of snap disc 17 and force transmitting means 31, it may be noted that the operation of switching means 37, 39 is completed, i.e. switch elements 43, 45 attain the another circuit controlling positions thereof, generally at preselected force levels indicated at points C and D in the graph of FIG. 6 with each preselected force level at points C and D being predeterminately greater than the aforementioned preselected force level at point B in the graph of FIG. 6, and movement of switch members 43, 45 between the one and another circuit controlling positions thereof is a "creeping" type movement. It may also be noted that the aforementioned initial rotation of rotatable means 53 places it at least adjacent switch element 47 for driving or switch operating engagement therewith.

Figure 6:
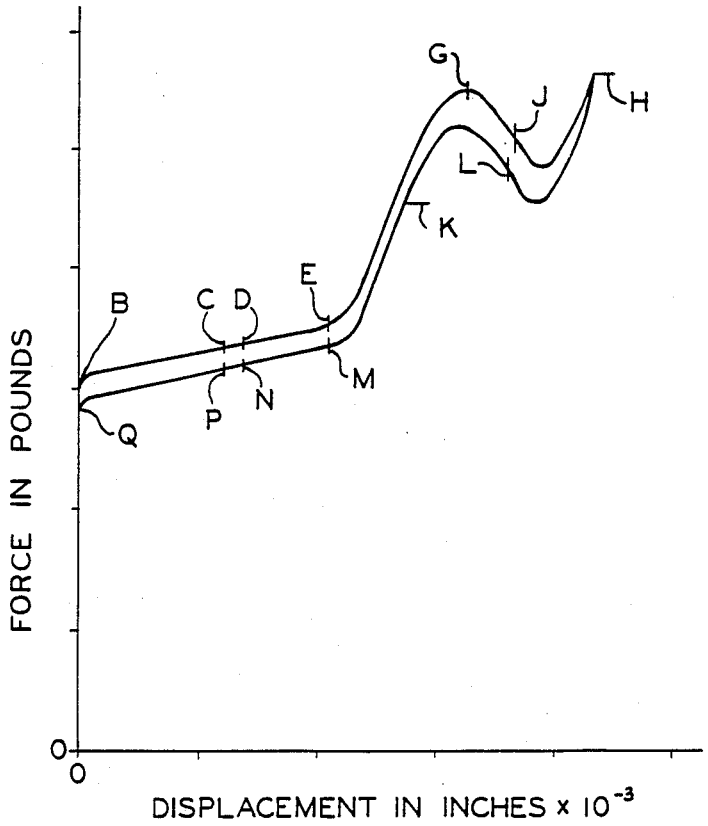
FIG. 6 is a graph illustrating an exemplary force-deflection or hysteresis curve for a typical electric circuit controlling device built in accordance with the preferred embodiment of the invention.

When force F attains a preselected force level indicated at point E in the graph of FIG. 6 which is predeterminately greater than the aforementioned preselected force levels at points B, C and D, the forementioned conjoint movement of snap disc 17 with force transmitting means 31 in response to force F acting thereon seats marginal edge 27 of the snap disc in abutment or seating engagement with housing seat 15 therefor. Upon the seating engagement of marginal edge 27 on snap disc 17 with housing seat 15, the discrete snap action movement of the snap disc from the stable configuration to the unstable configuration thereof occurs or is effected when force F is increased to another preselected force level indicated at point G in the graph of FIG. 6, and in response to such discrete snap action movement, the snap disc snaps directly into the position indicated at point H which is at least generally the same value as the preselected force level at point G.

In response to the discrete snap action movement of snap disc 17 into its unstable configuration, force F is transmitted in one direction from the snap disc onto actuator 55 moving it with snap action further generally axially through the linear movement thereof toward a protracted position in housing 13, and due to the engagement of rotatable means 53 with the actuator, the rotatable means is further rotated with snap action in the housing to engage switch element 47 and effect its operation with snap action from one of the circuit controlling positions thereof, as best seen in FIG. 3, toward another of the circuit controlling positions thereof, as best seen in FIG. 4. The switching operation of switch element 47 is completed generally at the preselected force level indicated at point J intermediate the preselected force levels at points G and H in the graph of FIG. 6.

In the event force F acting on force transmitting means 31 is decreased to the force level indicated at point K in the graph of FIG. 6, snap disc 17 snaps with discrete snap action movement from the unstable configuration into the stable configuration thereof while remaining seated against both housing seat 15 and ridge 29 on the force transmitting means which is, of course, conjointly movable with the snap disc. During the discrete snap action movement of snap disc 17 from point H to point K as illustrated in the graph of FIG. 6, the return operation of switch element 47 from the another circuit controlling position, as shown in FIG. 4, toward the one circuit controlling position thereof, as shown in FIG. 3, occurs generally at point L in the graph of FIG. 6. When snap disc 17 snaps from point H through point L to point K so as to return to its stable configuration, as discussed above, the force F transmitted from the snap disc through actuator 55 and rotatable means 53 onto switch element 47 is, of course, released therefrom, and the resilient force of the switch element effects its return operation from the another circuit controlling position, as shown in FIG. 4, into the one circuit controlling position thereof, as shown in FIG. 3, in following snap action relation or movement with the snap disc. Of course, rotatable means 53 is rotated in the clockwise direction of the directional arrow in FIG. 3 to return actuator 55 to its at-rest position in response to the resilient force of switch element 43 and overtravel spring 49 acting on the rotatable means. In response to further increases and decreases in force F acting on force transmitting means 31 between the forces levels at points G and K in the graph of FIG. 6, the force transmitting means will effect the cycling of snap disc 17 between the stable and unstable configurations thereof in the manner described above.

During the above discussed method of operating device 11, it may be noted that force F is applied in a preselected direction, i.e. generally axially, onto actuator 55 from snap disc 17 so as to move the actuator generally axially in housing 13 in the preselected direction of force F. Further upon the translation of force F from actuator 55 to rotatable means 53 to effect its rotation in housing 13, as discussed above, it may be further noted that the preselected direction of force F is changed in response to the rotation of the rotatable means and also that the force F is applied in the changed direction from the rotatable member onto switch elements 45, 47 and overtravel spring 49 to effect the operation of switch elements 43, 45, 47 from the one circuit controlling position to the another circuit controlling position thereof, respectively, as previously mentioned. Thus, to complete the discussion of the method of operating device 11, rotatable means 53 and actuator 55 comprise a means operable generally in response to force F exerted thereon in one direction by snap disc 17 for changing the direction of the force and for applying it onto switch means 37, 39, 41 to effect their operations.

With reference again to the drawings in general and recapitulating at least in part with respect to the foregoing, device 11 is shown as having housing 13 and snap disc 17 (FIGS. 1, 3 and 4). Provided in housing 13 is means, such as for instance generally annular and radially extending seat 15 or the like, for seating snap disc 17, and means, indicated generally at 61, are also provided in the housing for urging the snap disc toward its preselected displaced position (FIGS. 1 and 3). Force transmitting means 31 is operable generally for initially moving snap disc 17 from its preselected displaced position against urging means 61 into seating engagement with housing seat 15 and for thereafter effecting the discrete snap action movement of the snap disc from the stable configuration toward the unstable configuration thereof (FIGS. 3 and 4).

More particularly and with specific reference to FIGS. 1–4, housing 13 includes a pair of housing members or portions 63, 65 each having a plurality of walls or wall means. Upper housing member 63 has an end wall 67 integrally formed with a generally cylindric sidewall 69, and a generally radially extending abutment surface 71 is disposed on the upper housing member between the sidewall and a sleeve 73 integral with the sidewall and depending therefrom. An atmospheric chamber 75 is defined within sidewall 69 of upper housing member 63 generally between end wall 67 and abutment surface 71 thereof, and the atmospheric chamber is vented to the atmosphere through an atmospheric port or opening 77 in the sidewall of the upper housing member. A bore 79 having a pair of generally opposite ends or end portions 81, 81*a* is provided in end wall 67 generally coaxially about centerline axis 33 of device 11, and a partial spherical seat 83 facing atmospheric chamber 75 is defined on the end wall about the bore at least generally adjacent lower end 81*a* thereof so as to be generally coaxial with the centerline axis while upper end 81 of the bore defines a control port which is adapted to be subjected to the fluid pressure acting on effective area A of force transmitting means 31. If desired, a generally cylindric guide or guide means 85 may be provided on end wall 67 extending therefrom into atmospheric chamber 75 generally coaxially about partial spherical seat 83.

Lower housing member 65 also has an end wall 87 integrally formed with a generally cylindric stepped sidewall 89, and another generally radially extending abutment surface 91 is provided on the sidewall in axially spaced apart relation from the end wall. An electrical or switch chamber 93 is defined within sidewall 89 of lower housing member 65 generally between end wall 87 and abutment surface 91 thereof, and housing seat 15 is spaced between the end wall and the abutment surface so as to extend generally radially on the sidewall about the electrical chamber therein. A pair of sets of generally axially and opposed grooves or slots 95, 95*a* and 97, 97*a* are arranged generally in side-by-side relation in sidewall 89 of lower housing member 65 with each slot intersecting with seat 15, and if desired, slots 97, 97*a* may be provided with a generally V-shaped lower end, as seen in FIG. 2. A set of generally axially extending and diametrically opposed recesses or slots 99, 99*a* are also provided in sidewall 89 of lower housing member 65 intersecting with seat 15 thereof, and the opposed recesses are angularly spaced about the sidewall from opposed slots 95, 95*a* and 97, 97*a* therein.

When upper and lower housing members 63, 65 are associated in assembled relation with each other, as best seen in FIG. 1, a resilient diaphragm or diaphragm means 101 has its outer peripheral portion 103 sealably interposed between opposed abutment surfaces 71, 91 of upper and lower housing members 63, 65, respectively, thereby to isolate atmospheric chamber 75 and electrical chamber 93 from each other. When diaphragm 101 is sealably interposed between upper and lower housing members 63, 65, sleeve 73 on the upper housing member extends about confronting parts on sidewall 89 of the lower housing member, and the sleeve is deformed into gripping engagement with such confronting parts thereby to retain the upper and lower housing members against displacement from the assembled relation thereof. It is, of course, understood that upper and lower housing members 63, 65 may be formed of any suitable or desired material, such as for instance a resin, a metal or a metal alloy; however, in the aforementioned anti-skid brake system application contemplated for device 11 in an automotive vehicle (not shown), the upper housing member may be formed from a rust resistant metallic material, and the lower housing member may be formed of a thermoplastic material. Although upper and lower housing members 63, 65 are illustrated and discussed herein as having particular shapes and mounted together in a particular manner for purposes of disclosure, it is contemplated that various other housing members of different shapes and mounted together in different manners may be employed within the scope of the invention so as to meet at least some of the objects thereof.

Adjusting strap 57 may be formed of a relatively thin flexible material having spring-like characteristics, such as for instance stainless steel or the like, and is disposed in electrical chamber 93 beneath snap disc 17, as best seen in FIGS. 1, 3 and 4. An end or end portion 105 of strap 57 is seated in recess 99 of lower housing member 65, and a generally central or intermediate section 107 of the strap having an opening 109 therethrough is at least in part engaged in force transmitting contact or abutment with concave surface 25 of snap disc 17. Another end or end portion 111 of strap 57 remote from end 105 thereof depends away from snap disc 17 and is engaged by adjusting means, such as for instance an adjusting screw 113 or the like, threadedly received in a threaded opening 115 provided therefor through lower housing member 65 so as to intersect with recess 99*a* therein. Adjusting screw 113 through its contact with depending end 111 of strap 57 maintains central section 107 of the strap in the force transmitting or abutting engagement thereof with concave surface 25 of snap disc 17 and controls the degree of force applied at that generally central location to the snap disc. With this arrangement, calibration of snap disc 17 may be at least partially achieved by turning screw 113 with a suitable tool, such as a screwdriver or the like for instance (not shown), in the desired direction to either reduce or increase the adjusting or calibration force exerted on the snap disc by strap 57. Thus, it may be noted that the adjusting force exerted by strap 57 against snap disc 17 at least assists in its calibration to define the preselected force levels at points G and K in the graph of FIG. 6 at which the discrete snap action movement of the snap disc occurs between its stable and unstable configurations and also at least assists in urging the snap disc toward its preselected displaced position into engagement with circular ridge 29 of force transmitting means 31, as previously discussed and as best seen in FIG. 1. If a more detailed discussion of the construction and calibration operation of strap 57 is desired, reference may be had to U.S. Pat. No. 4,464,551 issued Aug. 7, 1984 to Ronald L. Johnson which is incorporated herein by reference.

Force transmitting means 31 comprises the following component parts: a piston 117, a ball or ball means 119, a push rod 121, a domed or dome-shaped connector 123 and a spacer 125 which are associated in abutment for conjoint movement in housing 13 of device 11, as discussed below. While the aforementioned component parts of force transmitting member and the abutting association thereof are discussed hereinafter for purposes of disclosure, it is contemplated that various other force transmitting means may comprise a greater or fewer number of such component parts or may be of a unitary construction, i.e. a single part, with such component parts having different shapes and being associated together in different manners within the scope of the invention so as to meet at least some of the objects thereof.

When snap disc 17 is in its preselected displaced position, its convex surface 23 is engaged with circular ridge 29 provided on spacer 125. Dome-shaped connector 123 is generally centrally secured to spacer 125 by suitable means, such as staking or the like for instance, and an inner peripheral portion 127 of diaphragm 101 is sealably interposed between the connector and the spacer. Thus, the sealing of inner peripheral portion 127 of diaphragm 101 between connector 123 and spacer 125 and the sealing engagement of outer peripheral portion 103 of the diaphragm between opposed abutment surfaces 71, 91 of upper and lower housing members 63, 65 in the assembled relation thereof is effective to isolate atmospheric and electrical chambers 75, 93 within housing 13, as previously mentioned. Push rod 121 has a pair of opposite ends or end portions 129, 129*a* comprising generally conic recesses provided for generally universal self-aligning relation or swiveling abutment with ball 119 and connector 123, respectively. In turn, ball 119 is abutted against partial spherical seat 83 provided therefor on end wall 67 of upper housing member 63 thereby to define the aforementioned at-rest position of force transmitting means 31 in housing 13. Piston 117 having a pair of generally opposite ends or end portions 131, 131*a* is slidably received in bore 79 of end wall 67 on upper housing member 63, and a seal or sealing means 133 is sealably arranged between upper end 131 of the piston and the housing member bore. The sealing engagement of seal 133 between upper end 131 of piston 117 and housing member bore 79 defines the forementioned effective area A on force transmitting means 31 which is subjected to the fluid pressure to establish the force F, and lower end portion 131*a* of the piston comprises another generally conic recess provided for generally universal self-aligning relation or swiveling abutment with ball 119 generally opposite the engagement thereof with upper end 129 of push rod 121.

Caged resilient means 35 is arranged in atmospheric chamber 75 of upper housing member 63 and includes a coil spring 135 having a pair of generally opposite end or ends faces 137, 137*a* abutted in seating engagement with a pair of opposite spring retainers or retaining means 139, 141 for containing or caging the compressive force of the spring. A pair of openings 143, 145 are generally centrally provided in spring retainers 139, 141 extending generally about push rod 121, and opening 143 in upper spring retainer 139 defines a seat or seating means urged by the caged compressive force of spring 135 into seating engagement with ball 129. Therefore, the caged compressive force of spring 135 is effective to bias ball 129 into seating engagement with partial spherical seat 83 on end wall 67 of upper housing member 63, and the engagement of the ball with the partial spherical seat defines the at-rest position of force transmitting means 31 in housing 13, as previously mentioned. Lower spring retainer 141 is press fitted or otherwise interconnected in displacement preventing engagement with sidewall 69 of upper housing member 63 within atmospheric chamber 75 thereof so as to predetermine the magnitude of the caged compressive force of spring 135 caged between upper and lower spring retainers 139, 141. Of course, opposite end faces 137, 137*a* of spring 135 are formed generally perpendicular to the axis thereof within preselected tolerance variations, such as for example generally about two degrees (2°); therefore, due to such tolerance variations, the spring may be side loaded, i.e. have side loading forces imparted thereto when caged between spring retainers 139, 141. In other words, the aforementioned side loading effect of spring 135 would tend to misalign or misdirect its caged compressive force generally angularly with respect not only to the spring axis but also with respect to centerline axis 33 of housing 13 through the biased engagement of seat 143 on upper spring retainer with ball 129. However, it is these tolerance variations and the resulting side loading effect thereof on spring 135 which are compensated by the above discussed universal self-aligning relation or swiveling abutment between piston 117, ball 119, push rod 121 and connector 123, as previously mentioned. Therefore, it may be noted that force transmitting means 31 is operable to direct force F acting thereon generally along centerline 33 of housing 13.

Actuator or actuator means 55 extends generally across electrical chamber 93 in lower housing member 65 and is slidably and guidably received in opposed housing slots 95, 95a for the aforementioned axial movement of the actuator between the at-rest and protracted positions thereof. A pair of opposite abutment ends or end portions 147, 147a are provided on actuator 55 for following or abutting engagement with concave surface 25 of snap disc 17 and rotatable means 53, respectively.

Rotatable means 53 includes a pair of generally opposite trunnions 149, 149a which are pivotally or rotatably supported on the V-shaped lower ends of opposed housing slots 97, 97a, and a pair of angularly spaced flanges or flange means 151, 153 are integrally formed between the opposite trunnions so as to extend in part across electrical chamber 93 in lower housing member 65. Flange 153 is engaged with switch element 45 and overtravel spring 49, and the resilient forces of the switch element and the overtravel spring acting on flange 153 effects the clockwise rotation of rotatable means 53 in the direction of the directional arrow in FIG. 3 toward the at-rest position thereof about its opposite trunnions 149, 149a to bias flange 151 into abutment with lower abutment end 147a of actuator 55 thereby to urge the actuator toward its at-rest position engaging upper abutment end 147 thereof with concave surface 25 of snap disc 17. Both rotatable means 53 and actuator 55 may be formed of any suitable material, such as for instance "Textolite" or the like, and while the rotatable means and the actuator are illustrated herein as translating means for transmitting force F from snap disc 17 to switch means 37, 39, 41 for purposes of disclosure, it is contemplated that various other force translating means having different configurations and cooperating in different manners may be utilized within the scope of the invention so as to meet at least some of the objects thereof.

Switch elements 43, 45, 47 may be formed of any suitable generally thin sheet material having the desired resilient and electrical conductive properties, such as for instance beryilliam copper or the like, and a set of electrical contacts or contact means 155, 157, 159 are secured in electrical conductive relation to the switch elements generally adjacent the upper or free ends thereof, respectively. The lower ends of switch elements 45, 47 are secured by suitable means, such as riveting or the like for instance, in electrical conductive and mounting relation to a common terminal 161 which is in part mounted to end wall 87 of lower housing member 65 so as to extend in part exteriorly thereof. Switch element 43 and overtravel spring 49 are arranged generally in overlaying relation, as previously mentioned, and the lower ends of both switch element 43 and the overtravel spring are abutted together and secured by suitable means, such as riveting or the like for instance, to another terminal 163 in electrical conductive relation therewith. Terminal 163 is mounted in part to end wall 87 of lower housing member 55 and extends in part exteriorly thereof. A set of stationary electrical contacts or contact means 165, 167, 169 are secured in electrical conductive relation to a set of terminals 171, 173, 175 for circuit making engagement with movable contacts 155, 157, 159 on switch elements 43, 45, 47 and for circuit breaking disengagement therefrom, and terminals 171, 173, 175 are mounted in part to end wall 87 of lower housing member 65 and extend in part exteriorly thereof. While terminals 161, 163, 171, 175, 177 are illustrated herein for purposes of disclosure as extending in part through openings provided therefor in end wall 87 of lower housing member 65 in interlocking or displacement preventing engagement therewith, it is contemplated that various other terminals having different configurations and mounted in device 11 in various different manners may be employed within the scope of the invention so as to meet at least some of the objects thereof. Thus, in the aforementioned one circuit controlling or at-rest positions of switch elements 43, 45, 47, as best seen in FIGS. 2 and 3, it may be noted that the resilient forces of switch elements 45, 47 urge contacts 157, 159 thereon into circuit making engagement with stationary contacts 167, 169 on terminals 173, 175, and the resilient force of overtravel spring 49 engages flange 51 thereof with switch element 43 thereby to bias switch element 43 in a direction breaking contact 157 thereon from stationary contact 167 on terminal 171. It may be further noted that the upper ends of switch element 45 and overtravel spring 49 are biased into engagement with flange 153 of rotatable means 53 to urge the rotatable means toward its at-rest position while the upper end of switch element 47 is spaced from the rotatable means flange. To complete the discription of device 11, a set of adjusting or calibrating pins 177, 179, 181 are press fitted into a set of openings 183, 185, 187 provided therefor in lower housing member 65 and into deforming engagement with terminals 171, 173, 175 so as to adjust stationary contacts 165, 167, 169 thereon with respect to movable contacts 155, 157, 159 on switch elements 43, 45, 47 thereby to adjust or calibrate the travel of switching means 37, 39, 41, as well known to the art.

Figure 5:
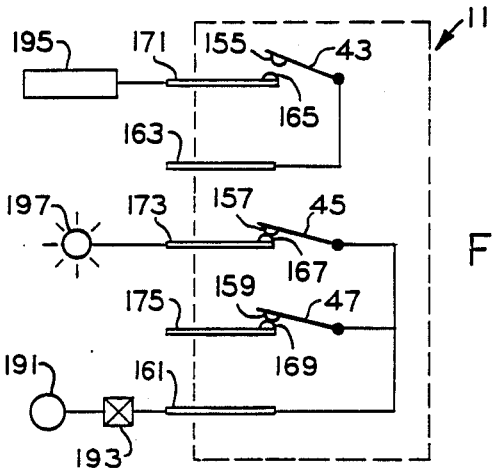
FIG. 5 is a simplified circuit diagram illustrating the switch elements of the electric circuit controlling device connected in circuit relation with some exemplary anti-skid brake system components.

As previously mentioned, the contemplated use of device 11 is for controlling certain electrical circuitry which may be utilized in the aforementioned anti-skid brake system for an automotive vehicle (not shown), and exemplary circuitry having exemplary components of such system are illustrated schematically in FIG. 5 in conjunction with the device, as discussed below. For instance, a pressure fluid pump or pumping means 191 and a normally closed relay 193 therefor are connected in circuit relation for energization and deenergization across terminals 161, 175 of device 11 with such energization and deenergization being controlled by switch element 47, and it is the fluid pressure developed by the pumping means upon the energization thereof to which housing bore 79 of the device is subjected, as discussed in greater detail hereinafter. At least some electronic components, indicated at 195, for effecting the anti-skid features or operation of the aforementioned anti-skid brake system are connected in circuit relation so as to be energized and deeneregized across terminals 163, 171 of device 11 with such energization and deenergization being controlled by switch element 43, and a warning lamp 197 for indicating whether or not such system is operative is connected in circuit relation so as to be energized and deenergized across terminals 161, 173 of the device with the energization and deenergization of such warning lamp being controlled by switch element 45. While device 11 is contemplated for use in the aforementioned anti-skid brake system, it is contemplated that such device may be utilized for controlling other electrical circuitry of systems other than such anti-skid brake system within the scope of the invention so as to meet at least some of the objects thereof.

In the operation of device 11, assume that the component parts thereof are in their at-rest positions, as described above and shown in FIGS. 1–3, and that the device is connected with the exemplary anti-skid brake system components, as discussed above with respect to FIG. 5. When a vehicle operator actuates the vehicle ignition switch (not shown) to an "on" or closed position thereof, pump 191 is energized through its relay 193 across terminals 161, 175 of device 11 since switch element 47 is in its at-rest or circuit making position therebetween, and warning lamp 197 is energized or illuminted across terminals 161, 167 of the device since switch element 45 is in its at-rest or circuit making position therebetween so as to indicate to the vehicle operator that the aforementioned anti-skid brake system is not yet operative.

Upon the energization of pump 191, it establishes fluid pressure to which housing bore 79 of device 11 is subjected, and the fluid pressure acts on effective area A of piston 117 in the housing bore to establish the aforementioned force F acting on force transmitting means 31. During the increase in the magnitude of force F from point O at the intersections of X and Y absicca of the graph in FIG. 6 to the force level at point B, it may be noted that the caged compressive force of caged resilient means 35 obviates movement or displacement of force transmitting means 31 in response to force F acting thereon. In response to the increase of force F from the force level at point B to that at point E, piston 117 is moved downwardly in housing bore 79 to conjointly move ball 119 from its housing seat 83 against upper spring retainer 139 and the caged compressive force of spring 135 acting thereon and the resilient force of the aforementioned urging means 61 acting against snap disc 17 to maintain it seated against circular ridge 29 on spacer 125. Of course, push rod 121, connector 123 and spacer 125 are conjointly movable downwardly with piston 117 and ball 119 to effect the seating or engagement of marginal edge 27 on snap disc 17 with housing seat 15 when force F attains the force level at point E. As previously mentioned, the self-aligning relation between piston 117 and ball 119 and between push rod 121 and both the ball and domed connector 123 is effective to assure that force F is exerted on snap disc 17 along centerline axis 33 of device 11 by force transmitting means 31.

During the aforementioned displacement of force transmitting means 31 between points B and E in the graph of FIG. 6 to seat marginal edge 27 of snap disc 17 on housing seat 17, the abutments of upper and lower ends **137, 137*a* on actuator 55 with concave surface 25 on the snap disc and flange 151 of rotatable means 53 effects the initial axial movement of the actuator in housing slots 95, 95*a* thereby initially to rotate the rotatable means the counterclockwise direction of the directional arrow in FIG. 4 on its trunnions 149, 149*a* in housing slots 97, 97*a*. In response to this initial rotation of rotatable means 53 generally as force F attains the force level at point C in the graph of FIG. 6, flange 153 on the rotatable means drives or moves switch element 45 toward an open or circuit breaking position disengaging contact 157 thereon from stationary contact 167 thereby to interrupt the circuit through device 11 between terminals 161, 173 and effect the deenergization of warning lamp 197 turning it off. In response to further initial rotation of rotatable means 53 generally as force F attains the force level at point D in the graph of FIG. 6, flange 153 on the rotatable means drives or moves overtravel spring 49 toward a position disengaging its flange 51 from switch element 43 upon the movement thereof into a closed or circuit making position engaging contact 155 thereon with stationary contact 167 thereby to complete the circuit through device 11 between terminals 163, 171 thereof and effect the enablement of electronic components 195. While switch element 45 is actuated at point C and switch element 43 at point D in the graph of FIG. 3, it is contemplated that switch element 45 may be actuated at point D and switch element 43 at point C or that such switch elements may be actuated at least generally simultaneously at some preselected point on the graph in FIG. 6** within the scope of the invention so as to meet at least some of the objects thereof.

When marginal edge 27 of snap disc 17 is engaged with housing seat 15, as described above, force transmitting means 31 is further movable in response to an increase in force F from the force level at point E to that at point G in the graph of FIG. 6 to effect the discrete snap action movement of the snap disc from the stable configuration into the unstable configuration thereof. Thus, when force F attains the force level at point G, snap disc 17 is displaced or moved with snap action from its stable configuration at point G to the unstable configuration thereof at point H which is at least generally at the same force level as point G, and force transmitting means 31 is, of course, conjointly movable with the snap disc through its discrete snap action movement. During the discrete snap action movement of snap disc 17 from point G to point H in the graph of FIG. 6, the snap disc further moves actuator 55 axially downwardly in housing slots **95, 95*a* thereby to further rotate rotatable means 53 counterclockwise on its trunnions 149, 149*a* in housing slots 97, 97*a*. It may be noted that the aforementioned further axial movement of actuator 55 and further rotational movement of rotatable means 53 is achieved with snap action in response to the discrete snap action movement of snap disc 17 from the stable configuration into the unstable configuration thereof, as discussed above. Upon the further snap action rotation of rotatable means 53, flange 153 thereon engages and drives switch element 47 with snap action movement toward an open or circuit breaking position disengaging contact 159 thereon from stationary contact 169 thereby to interrupt or break the circuit through device 11 between terminals 161, 175 thereof. As indicated in the graph of FIG. 6, the above discussed breaking of switch element 47 occurs intermediate points G and H at point J, and in response thereto, normally closed relay 193 is opened, i.e., "dropped-out", thereby to effect the deenergization of pump 191. In the event force F is decreased from the force level at point H to that at point K in the graph of FIG. 6, snap disc 17 returns with discrete snap action movement from its unstable configuration at point H to its stable configuration at point K, and force transmitting means 31 is, of course, conjointly movable in device 11 with the snap disc. During this discrete snap action movement of snap disc 17 from the unstable configuration into the stable configuration thereof, the resiliency or resilient force of switch element 47 effects the movement thereof with snap action toward a closed or circuit making position engaging contact 159 thereon with stationary contact 169 thereby to make or complete the circuit through device 11 between terminals 161, 175 thereof. As indicated in the graph of FIG. 6, the above discussed making of switch element 47 occurs intermediate points H and K at point L, and in response thereto relay 193 is closed, i.e. "picked-up" thereby to effect the reenergization of pump 119. When snap disc 17 returns to its stable configuration, as discussed above, the resiliency or resilient forces of switch element 45 and overtravel spring 49 biased against flange 153 on rotatable means 53 effects the clockwise rotation thereof about trunnions 149, 149***a* in housing slots 97, 97*a* moving actuator axially upwardly in housing slots 95, 95*a* in following relation with the return movement of the snap disc from the unstable configuration into the stable configuration thereof when marginal edge 27 of the snap disc is seated against housing seat 15 therefor. Of course, force transmitting means 31 is responsive to increases and decreases in the magnitude of force F between the force levels at points G and K in the graph of FIG. 6 for cycling snap disc 17 between the stable and unstable configurations thereof to effect the snap action operation of switch element 47 for energizing and deenergizing pump 191 in the manner discussed above.

When force F is eliminted or reduced to point O in the graph of FIG. 6, the caged compressive force of caged resilient means 35 effects the return movement of force transmitting means 31 to permit the disengagement of marginal edge 27 on snap disc 17 from housing seat 15 at point M and to reengage ball 119 with housing seat 83 therefor at point Q. Of course, actuator 55 and rotatable means 53 follow the return movement of snap disc 17 between points M and Q in the graph of FIG. 6 in the previously discussed manner, and the return rotation of the rotatable means permits switch element 43 to open disengaging its contact 155 from stationary contact 165 thereby to interrupt or break the circuit through device 11 between terminals 163, 171 thereof so as to disable electronic components 195. At point P in the graph of FIG. 6, the return rotation of rotatable means 53 permits switch element 45 to close reengaging its contact 157 with stationary contact 167 thereby to complete or remake the circuit through device 11 between terminals 161, 173 thereof so as to reenergize or reilluminte warning light 197.

From the foregoing, it is now apparent that a novel a novel method of operating an electric circuit controlling device has been presented meeting the objects and advantageous features set out hereinabove, as well as others, and it is contemplated that modifications as to the precise configurations, details and connections of component parts utilized in the method, as well as the precise steps of such method, may be made by those having ordinary skill in the art without departing from the spirit of the invention or from the scope thereof as set out in the claims which follow.

What I claim is:

1. A method of operating an electric circuit controlling device, the device including snap action means for discrete snap action movement between a stable configuration and an unstable configuration thereof, a housing, and a seat in the housing, the method comprising the steps of:

disposing the snap action means in its stable configuration in an at-rest selected position having all parts thereof displaced from the housing and the housing seat;

exerting a force in excess of a preselected force level onto the snap action means and moving the snap action means from its an at-rest selected position toward the housing seat;

seating the snap action means on the housing seat at least generally as the force attains another preselected force level predeterminately greater than the first named preselected force level; and effecting the discrete snap action movement of the snap action means from the stable configuration toward the unstable configuration thereof when the force attains a third force level predeterminately greater than the another force level.

2. The method as set forth in claim 1 wherein the device further includes force transmitting means for movement in the housing, and wherein the disposing step includes seating the snap action member in its at-rest selected position against the force transmitting means.

3. The method as set forth in claim 2 wherein the exerting step includes applying the force onto the force transmitting means and effecting thereby conjoint movement of the force transmitting means and the snap action member when the force exceeds the first named preselected force level.

4. The method as set forth in claim 3 wherein the device further includes a caged spring having a caged compressive force, and wherein the exerting step further includes biasing the caged compressive force of the caged spring against the force transmitting means to oppose its movement and obviating the movement of the force transmitting means until the force attains the first named preselected force level.

5. The method as set forth in claim 3 wherein the exerting and moving step further includes subjecting the force transmitting means to fluid pressure and establishing thereby the force applied onto the force transmitting means.

6. The method as set forth in claim 1 wherein the device further includes at least one switching means operable generally for switching between a plurality of circuit controlling positions, and wherein the effecting step includes operating the at least one switching means with snap action from one of the circuit controlling positions toward another of the circuit controlling positions thereof in response to the discrete snap action movement of the snap action means.

7. The method as set forth in claim 1 wherein the device further includes at least one switching means operable for switching between a plurality of circuit controlling positions, and wherein the moving step includes operating the at least one switching means from one of the circuit controlling positions toward another of the circuit controlling positions thereof in response to the movement of the snap action means from its at-rest position toward the housing seat.

8. The method as set forth in claim 1 wherein the device further includes a set of switching means operable generally for switching between a plurality of circuit controlling positions, and wherein the moving step includes operating at least one of said switching means with creeping movement from one of the circuit controlling positions toward another of the circuit controlling positions thereof in response to the movement of the snap action means from its at-rest position toward the housing seat, and the effecting step including translating at least another of the switching means with snap action movement from one of the circuit controlling positions toward another of the circuit controlling positions thereof in response to the discrete snap action movement of the snap action means from the stable configuration to the unstable configuration thereof.

9. The method as set forth in claim 1 wherein the device further includes at least one switching means operable generally for switching between a plurality of circuit controlling positions, and force translating means operable generally for changing the direction of a force applied thereto, and wherein the moving step includes transmitting the force exerted during the exerting step from the snap action means in a preselected direction onto the force translating means effecting its operation to change the direction of the force and applying the force in the changed direction thereof from the force translating means against the at least one switching means to effect its operation with creeping movement from one of the circuit controlling positions toward another of the circuit controlling positions thereof prior to the seating of the snap action means on the housing seat.

10. The method as set forth in claim 1 wherein the device further includes at least one switching means operable generally for switching between a plurality of circuit controlling positions, and force translating means operable generally for changing the direction of a force applied thereto, and wherein the effecting step includes transmitting the force at least when it attains the third preselected force level from the snap action means in a preselected direction onto the force translating means effecting its operation to change the direction of the force and applying the force in the changed direction thereof from the force translating against the at least one switching means to effect its operation with snap action movement from one of the circuit controlling positions toward another of the circuit controlling positions thereof in response to the discrete snap action movement of the snap action means from the stable configuration to the unstable configuration thereof.

11. The method as set forth in claim 1 wherein the device further includes a set of switching means operable generally for switching between a plurality of circuit controlling positions, respectively, and force translating means operable generally for changing the direction of a force applied thereto, and wherein the moving step includes transmitting the force in excess of the first named preselected force level from the snap action means in a preselected direction onto the force translating means effecting its operation to change the direction of the force and applying the force in its changed direction from the force translating means against at least one of the switching means to effect its operation with creeping movement from one of the circuit controlling positions toward another of the circuit controlling positions thereof at least upon the seating of the snap action means on the housing seat, and wherein the effecting step includes further operating the force translating means at least when the force attains the third preselected force level to engage and operate at least another of the switching means with snap action movement from one of the circuit controlling positions toward another of the circuit controlling positions thereof in response to the discrete snap action movement of the snap action means from the stable configuration toward the unstable configuration thereof.

12. A method of operating an electric circuit controlling device, the device including snap action means for discrete snap action movement between a stable configuration and an unstable configuration, a housing, and a seat in the housing, the method comprising the steps of:

moving the snap action means in its stable configuration from an at-rest position displaced from the housing seat into a seated position in engagement with the housing seat and effecting the discrete snap action movement of the snap action means from the stable configuration toward the unstable configuration thereof when the snap action means in its seated position is engaged with the housing seat.

13. The method as set forth in claim 12 wherein the device further includes at least one switching means operable generally for switching between a plurality of circuit controlling positions, and wherein the effecting step includes operating the at least one switching means with snap action from one of the circuit controlling positions toward another of the circuit controlling positions thereof in response to the discrete snap action movement of the snap action means from the stable configuration toward the unstable configuration thereof.

14. The method as set forth in claim 12 wherein the device further includes at least one switching means operable generally for switching between a plurality of circuit controlling positions, and wherein the moving step includes operating the at least one switching means from one of the circuit controlling positions toward another of the circuit controlling positions thereof in response to the movement of the snap action means from its at-rest position into engagement with the housing seat.

15. The method as set forth in claim 12 wherein the device further includes a set of switching means operable generally for switching between a plurality of circuit controlling positions, respectively, and wherein the effecting step includes operating at least one of the switching means from one of the circuit controlling positions toward another of the circuit controlling positions thereof in response to the discrete snap action movement of the snap action means from the stable configuration toward the unstable configuration thereof and wherein the moving step includes translating at least another of the switching means with creeping movement from one of the circuit controlling positions toward another of the circuit controlling positions thereof prior to the operating step in response to the movement of said snap action means from its at-rest position into its seated position in engagement with the housing seat.

16. The method as set forth in claim 12 further comprising the preliminary step of urging the snap action means into its at-rest position.

17. The method as set forth in claim 11 wherein the device further includes force transmitting means for movement in the housing, and wherein the method further comprises the preliminary step of engaging the snap action means in its at-rest position with the force transmitting means and applying a force onto the force transmitting means to effect its movement conjointly with the snap action means during both the moving step and the effecting step.

18. The method as set forth in claim 17 wherein the device further includes a caged resilient member having a caged resilient force, and wherein the method further comprises the further preliminary step of exerting the caged resilient force of the caged resilient member against the force transmitting means and obviating thereby the conjoint movement of the force transmitting means and the snap action means at least until the force applied onto the force transmitting member attains a preselected force level.

19. The method as set forth in claim 11 wherein the device further includes at least one switching means operable generally with creeping movement for switching between a plurality of circuit controlling positions, and force translating means operable generally for changing the direction of a force exerted thereon, and wherein the moving step includes transmitting the force in a preselected direction from the snap action means upon its movement between the at-rest and seated positions onto the force translating means effecting its operation to change the direction of the force and applying the force in its changed direction from the force translating means against the at least one switching means to effect its operation with creeping movement from one of the circuit controlling positions toward another of the circuit controlling positions thereof.

20. The method as set forth in claim 19 wherein the device further includes at least another switching means operable generally for switching between a plurality of circuit controlling positions, and wherein the method further comprises the additional step of exerting the force from the snap action means in response to its discrete snap action movement toward the unstable configuration so as to effect further operation of the force translating means and actuating thereby the force translating means into engagement with the at least another switching means to effect its operation with snap action movement from one of the circuit controlling positions toward another of the circuit controlling positions thereof.

21. A method of operating an electric circuit controlling device having snap action means for discrete snap action movement between a stable configuration and an unstable configuration thereof, a reciprocally movable member, a rotatable member, and at least one switching means for switching between a plurality of circuit controlling positions, the method comprising the steps of:

effecting the discrete snap action movement of the snap action means from the stable configuration toward the unstable configuration thereof and establishing thereby a force in a preselected direction;

applying the force in the preselected direction onto the reciprocally movable member and moving the reciprocally movable member in the preselected direction of the force applied thereon;

translating the force from the reciprocally movable member during the movement thereof in the preselected direction onto the rotatable member and causing thereby the rotation of the rotatable member; and changing the direction of the preselected direction of the force in response to the rotation of the rotatable member and applying the force in the changed direction thereof from the rotatable member to the at least one switching means so as to effect the operation of the at least one switching means from one of the circuit controlling positions toward another of the circuit controlling positions thereof.

22. The method as set forth in claim 21 wherein the rotatable member has a pair of flanges, and wherein the translating step includes exerting the force on one of the flanges from the reciprocally movable member.

23. The method as set forth in claim 22 wherein the causing step includes rotating the flanges conjointly with the rotatable member in response to the exerting step, and the applying step including transferring the force from the other of the flanges to the at least one switching means.

24. The method as set forth in claim 21 wherein the device further includes a housing having a pair of generally opposed grooves therein, and wherein the moving step includes to the further axial movement of the actuator means during the moving step and applying the force from the rotatable means onto at least another of the switch elements during the rotating step and operating thereby the at least another switch element with snap action from one of the circuit controlling positions to another of the circuit controlling positions thereof. guiding the reciprocally movable member in the opposed grooves to define the preselected direction of the movement of the reciprocally movable member.

25. The method as set forth in claim 21 wherein the device further includes a housing having a pair of opposed recesses therein, and wherein the causing step includes rotating the rotatable member in the opposed recesses, respectively.

26. A method of operating an electric circuit controlling device, the device including a housing having a seat therein, a snap disc having opposed convex and concave surfaces with a marginal edge interposed therebetween and being operable generally with discrete snap action movement between a stable configuration and an unstable configuration, force transmitting means for movement in the housing, a caged spring, actuator means for axial movement in the housing, rotatable means for rotatable movement in the housing, and a set of resilient switch elements operable generally between a plurality of circuit controlling positions, respectively, the method comprising the steps of;

exerting the compressive force of the caged spring against the force transmitting means urging it toward an at-rest position in the housing;

applying the resiliency of at least one of the switch elements in one of the circuit controlling positions thereof onto the rotatable means rotating it into engagement with the actuator means to axially move the actuator means into abutment with the concave surface of the snap disc and biasing thereby the convex surface of the snap disc into engagement with the force transmitting means in the at-rest position thereof with the marginal edge of the snap disc being spaced from the housing seat;

subjecting the force transmitting means to fluid pressure and establishing thereby a force acting on the force transmitting means in opposition to the compressive force of the caged spring and the resiliency of the at least one switch element;

displacing the force transmitting means from its at-rest position when the force acting thereon exceeds a preselected force level and moving the snap disc conjointly with the force transmitting means toward the housing seat;

actuating the actuator means in part through its axial movement and the rotatable means in part through its rotatable movement and operating thereby the at least one switch element from the one circuit controlling position toward another of the circuit controlling positions thereof in response to the movement of the snap disc toward the housing seat during the moving step;

seating the marginal edge of the snap disc in its stable configuration against the housing seat in response to the conjoint movement of the snap disc with the force transmitting means when the force acting thereon attains another preselected force level predeterminately greater than the first named preselected force level;

effecting the discrete snap action movement of the snap disc from the stable configuration toward the unstable configuration thereof when the force acting on the force transmitting means attains a third preselected force level predeterminately greater than the another preselected force level and transmitting the force from the snap disc in one direction onto the actuator means;

moving further the actuator means axially in response to the force transmitted in the one direction thereon by the snap disc upon its discrete snap action movement during the effecting step;

rotating further the rotatable means in response

* * * * *